US009963862B2

(12) United States Patent
Carpenter-Crawford

(10) Patent No.: US 9,963,862 B2
(45) Date of Patent: May 8, 2018

(54) ELASTIC MEMBRANE STRAINER FOR A DRAIN

(71) Applicant: BrassCraft Manufacturing Company, Novi, MI (US)

(72) Inventor: Evan A. Carpenter-Crawford, Farmington, MI (US)

(73) Assignee: Brasscraft Manufacturing Company, Novi, MI (US)

( * ) Notice: Subject to any disclaimer, the term of this patent is extended or adjusted under 35 U.S.C. 154(b) by 0 days. days.

(21) Appl. No.: 14/636,518

(22) Filed: Mar. 3, 2015

(65) Prior Publication Data

US 2016/0040410 A1 Feb. 11, 2016

Related U.S. Application Data

(60) Provisional application No. 62/034,335, filed on Aug. 7, 2014.

(51) Int. Cl.

| | |
|---|---|
| ***E03C 1/26*** | (2006.01) |
| ***E03C 1/264*** | (2006.01) |
| ***E03C 1/04*** | (2006.01) |
| ***E03C 1/18*** | (2006.01) |
| ***B05B 1/06*** | (2006.01) |
| ***B05B 1/12*** | (2006.01) |
| ***B05B 1/16*** | (2006.01) |

(Continued)

(52) U.S. Cl.

CPC ..... *E03C 1/264* (2013.01); *B05B 1/06* (2013.01); *B05B 1/12* (2013.01); *B05B 1/1618* (2013.01); *B05B 1/1663* (2013.01); *B05B 1/3046* (2013.01); *B05B 12/002* (2013.01); *E03C 1/0405* (2013.01); *E03C 1/18* (2013.01); *E03C 1/26* (2013.01)

(58) Field of Classification Search

CPC ..... E03C 1/264

See application file for complete search history.

(56) References Cited

U.S. PATENT DOCUMENTS

| | | | | |
|---|---|---|---|---|
| 1,494,882 A | | 5/1924 | Barger | |
| 4,471,497 A | * | 9/1984 | Riutort | E03C 1/264 4/286 |
| 7,736,499 B2 | | 6/2010 | Chong et al. | |

(Continued)

FOREIGN PATENT DOCUMENTS

WO 2008045729 4/2008

OTHER PUBLICATIONS http://www.etindustries.com/SinkTastic_Stopper/; ET Industries—a divisioin of Protoplast Inc., ET Industries located at Protoplast, Inc. 2-21- Willmott Street, P.O. Box 310, Cobourg, Ontario, Canada K9A 4K8, Copyright 2014, 4 pages, Website advertisement.

(Continued)

*Primary Examiner* — Janie Loeppke

(74) *Attorney, Agent, or Firm* — Reising Ethington, P.C.

(57) ABSTRACT

The present disclosure includes a drain strainer with a central longitudinal axis. A rigid base includes a radially outer base periphery, a radially inner base periphery, and upper and lower surfaces therebetween, and extending in a base plane transverse to the axis. A flexible, elastic membrane is coupled to the rigid base, and includes a perforate web extending in a membrane plane transverse to the axis. Also disclosed is a sink including the strainer.

20 Claims, 3 Drawing Sheets

(51) Int. Cl.
*B05B 1/30* (2006.01)
*B05B 12/00* (2018.01)

(56) References Cited

U.S. PATENT DOCUMENTS

| | | | | |
|---|---|---|---|---|
| 7,832,027 | B2 * | 11/2010 | Escobar | E03C 1/262 4/286 |
| 8,117,685 | B2 | 2/2012 | Escobar et al. | |
| D691,245 | S | 10/2013 | Ho | |
| 2003/0032569 | A1 * | 2/2003 | Takemura | A01N 25/34 510/195 |
| 2006/0273002 | A1 * | 12/2006 | Maymudes | E03C 1/264 210/460 |
| 2010/0213140 | A1 * | 8/2010 | Won | E03C 1/264 210/767 |

OTHER PUBLICATIONS https://www.oxo.com_p-210-shower-stall-drain-protector.pdf, Shower Stall Drain Protector #1288100V2, located at 1331 South Seventh Street, Second Floor, Chambersburg, Pennsylvania 17201, 1 page, Website advertisement.

https://www.oxo.com_p-210-shower-stall-drain-protector2.pdf, Shower Stall Drain Protector #1288100V2, Features and Benefits, located at 1331 South Seventh Street, Second Floor, Chambersburg, Pennsylvania 17201, 1 page, Website advertisement.

https://www.kickstarter.com/Projects/1371613126/tweak; Tweak drain, by Nitzan Shafat & Aviv Rozenfeld, Kickstarter, Inc. located in Tel Aviv, Israel, Copyright 2014, 10 pages, Website advertisement.

* cited by examiner

ELASTIC MEMBRANE STRAINER FOR A DRAIN

CROSS-REFERENCE TO RELATED APPLICATION

This application claims the benefit of U.S. Provisional Application No. 62/034,335, filed Aug. 7, 2014. The content of the above application is incorporated herein by reference in its entirety.

TECHNICAL FIELD

This disclosure relates generally to strainers for drains.

BACKGROUND

A typical drain for a kitchen sink usually includes a strainer housing carried in a drain hole in a bottom of the sink, and a strainer basket removably carried in the strainer housing. The strainer housing typically includes a circular flange supported around the drain hole on an upper surface of the sink bottom, and a cylindrical cup depending downwardly from the flange through the drain hole. The strainer basket is easily clogged with debris, thereby causing water to back up in the sink, and can be difficult to clean.

BRIEF SUMMARY

An illustrative embodiment of a drain strainer with a central longitudinal axis includes a rigid base including a radially outer base periphery, a radially inner base periphery, and upper and lower surfaces therebetween, and extending in a base plane transverse to the axis. The strainer also includes a flexible, elastic membrane coupled to the rigid base, and including a perforate web extending in a membrane plane transverse to the axis.

DETAILED DESCRIPTION

Figure 1:
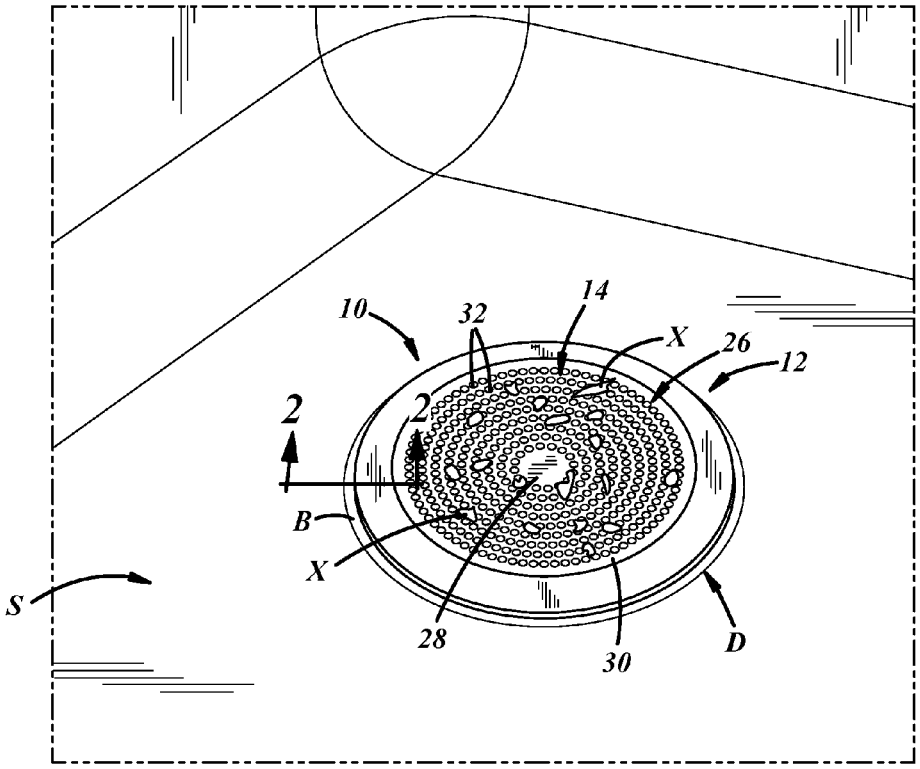
FIG. 1 is a fragmentary, schematic view according to an illustrative embodiment of an elastic membrane strainer, which is shown carried by a sink drain, trapping debris thereon, but allowing water to flow therethrough.
Figure 2:
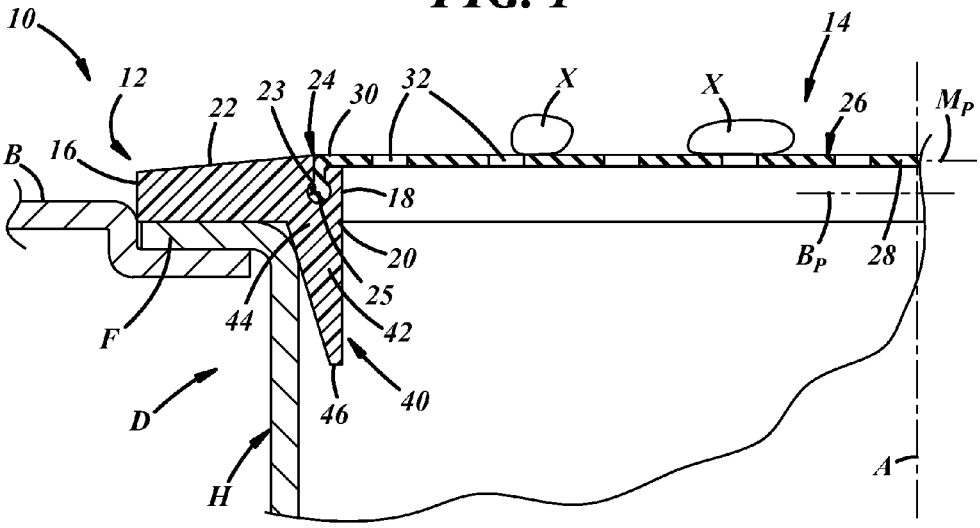
FIG. 2 is an enlarged, fragmentary, sectional view taken from line 2-2 of FIG. 1.

Referring specifically to the drawings, FIGS. 1 and 2 show an illustrative embodiment of an elastic membrane strainer 10, which may be used to cover a drain D of a sink S, a shower (not shown), or the like. The strainer 10 can collect debris X, which is easily wiped away from the strainer 10 or easily displaced by running water. Accordingly, water W tends to not back up in the sink S and, instead, flows through the strainer 10 and down the drain D.

With reference to FIG. 2, the strainer 10 generally may include a central longitudinal axis A, a base 12 extending transversely with respect to the axis A, and a membrane 14 coupled to the base 12 and also extending transversely with respect to the axis A to strain water as it flows therethrough down the drain D. The strainer 10 need not include central shafts, shanks, support pins, or the like for support. Also, the strainer 10 need not include separate handles coupled to the membrane 14, separate fasteners, baskets, plugs, and other complexities of prior art drain strainers.

The illustrated wall thicknesses of the various portions of the strainer 10 present just one example. The walls may be thinner or thicker than that shown, and the wall thicknesses may vary from one portion of the strainer 10 to another. Those of ordinary skill in the art will recognize that the wall thicknesses are application-specific and depend on performance requirements, material(s) used, and the like.

The base 12 may be relatively rigid and may include a radially outer base periphery 16, a radially inner base periphery 18, and lower and upper surfaces 20, 22 therebetween. Accordingly, the base 12 may be an annulus extending completely circumferentially around the axis A, as shown in the illustrated embodiment. The upper surface 22 may be beveled. For example, the base 12 may be axially thicker at the radially inner base periphery 18 than at the radially outer base periphery 16. And the upper surface 22 may be straight. The base 12 may include a membrane coupling pocket 23 in the upper surface 22 and radially outward of the radially inner base periphery 18 for receiving a corresponding portion of the membrane 14, as discussed in more detail below. The base 12 extends in a base plane Bp substantially perpendicular to the axis A.

Likewise, the membrane 14 extends in a membrane plane Mp substantially perpendicular to the axis A and parallel to the base plane. In fact, as illustrated, the membrane 14 is substantially co-planar with the base, such that the membrane plane Mp overlaps the base 12 between the upper and lower surfaces 22, 20 of the base 12. But the membrane 14 may be flexible, relative to the rigid base 12, and may be elastic such that it can be displaced from its planar state shown in FIGS. 1-3 to a stretched state shown in FIG. 4. As used herein, the terminology "substantially perpendicular" includes within plus or minus ten angular degrees.

With reference to FIG. 2, the membrane 14 includes a radially outer membrane periphery 24 coupled to the rigid base 12 and a perforate web 26 extending radially inwardly from the periphery 24. As used herein, the term "perforate" includes structure having holes, spaces, pores, interstices, or any other water permeable structure. The membrane 14 includes a base coupling portion 25 carried in the membrane coupling pocket 23. The coupling portion 25 may be thicker than the web 26 and/or a portion of the membrane 14 that is radially inwardly adjacent to the coupling portion 25. For example, the coupling portion 25 may include an enlargement, like a bead as illustrated in FIG. 2.

Figure 4:
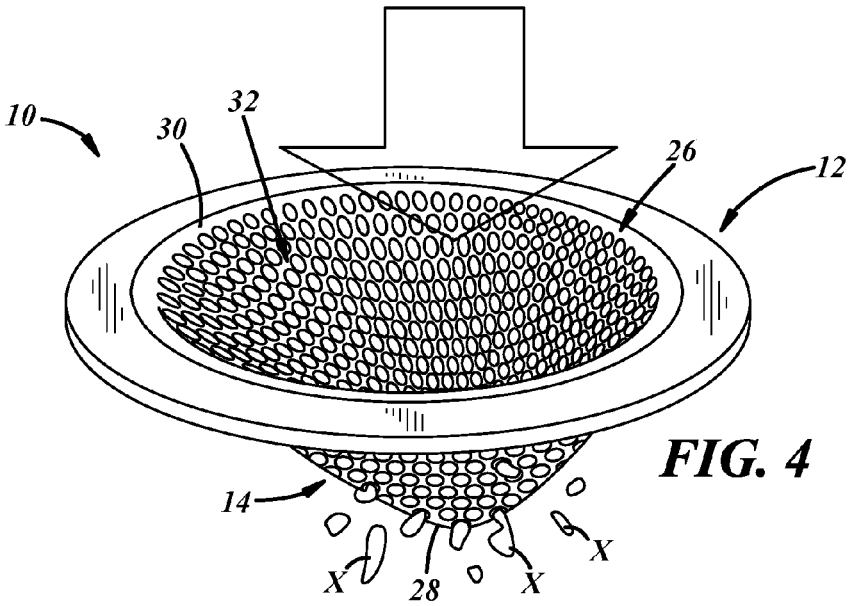
FIG. 4 is an enlarged perspective view of the strainer of FIG. 1, shown in a stretched position, wherein an elastic membrane of the strainer is being flexed away from a relatively rigid rim of the strainer to release debris therefrom.

With reference to FIG. 4, the perforate web 26 may include an imperforate central portion 28 to facilitate depression and deflection of the membrane 14 (as illustrated in FIG. 4). The perforate web 26 also may include an imperforate radially outer margin 30, and a plurality of apertures 32 radially between the imperforate central portion 28 and the imperforate radially outer margin 30. The plurality of apertures 32 may include a circular array of apertures and, more particularly, may include circular holes as illustrated.

With reference to FIG. 2, the base 12 may be supported by the sink bottom B and/or a flange F of a strainer housing H at a seam between the sink bottom B and a radially outer edge of the flange F. The strainer 10 may be configured to be interference fit to the sink/flange seam, wherein a radially outer strainer periphery of the strainer 10 is configured for an interference fit (e.g., a snap fit) with a corresponding radially inner seam periphery of the sink/flange seam.

Additionally, or alternatively, the strainer 10 may include a drain coupling 40, which may include a tubular coupling sidewall 42 having an upper end 44 coupled to the base 12, extending downwardly from the base 12, and terminating in an open lower end 46. The tubular coupling sidewall 42 may be frustoconical. For example, the upper end 44 may be relatively radially thick and, likewise, the lower end 46 may be relatively radially thinner than the upper end 44. Accordingly, the sidewall 42 may extend axially downwardly from the base 12 at a radially inward angle with respect to the base 12. In other embodiments, the sidewall 42 may be straight. The base 12 and the drain coupling 40 may be of unitary construction, as shown in the illustrated embodiment, but may be of separate construction and assembled, fused, fastened, or otherwise coupled together in any suitable manner. In another embodiment, the drain coupling 40 may be of unitary construction with the membrane 14, for example, a portion extending axially beyond the coupling portion 25, through the base 12, and into the drain opening.

With reference to FIG. 4, at least the web 26 of the membrane 14 may be deflected and stretched to elongate, enlarge, or otherwise deform the apertures 32 to facilitate release of debris X that may be caught therein. The central portion 28 may provide a good spot for a user to place a finger to depress and stretch the web 26. In the deflected/stretched state, the membrane 14 may be conical in shape, as exemplified by FIG. 4.

Figure 3:
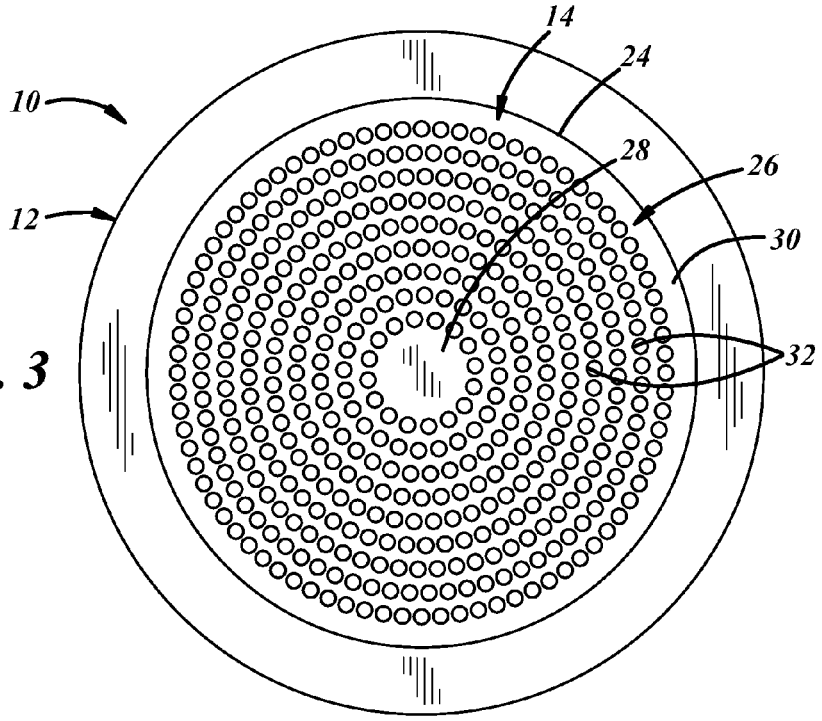
FIG. 3 is an enlarged top view of the strainer of FIG. 1.

Conversely, as shown in FIGS. 1-3, in a state of rest, the membrane 14 is flat. Likewise, the membrane 14 may be smooth for easy wiping of debris therefrom.

Any suitable materials can be used in making the strainer 10, such as metals, composites, polymeric materials, and/or the like. The phrase "polymeric materials" generally includes relatively high-molecular-weight materials of either synthetic or natural origin and may include thermosets, thermoplastics, and/or elastomers. The term "elastomeric" generally includes a material, which at room temperature, can be stretched under low stress to about twice its original length or more and, upon release of the stress, will return with force to its approximate original length. Elastomeric also encompasses any of various elastic substances that may be rubber-like. For example, the base 12 may be composed of a thermoplastic material, for instance, polyethylene, and the membrane 14 may be composed of an elastomeric material, for instance, silicone.

In general, the strainer 10 can be manufactured according to techniques known to those skilled in the art, including molding, machining, stamping, casting, and/or the like. In one embodiment, the strainer 10 may include two separate components that are coupled together, such that the strainer 10 may be a two-piece assembly or article of manufacture.

In one example, the membrane 14 may be co-molded (or co-injection molded) with the base 12, over-molded (or insert-molded) onto the base 12, or molded according to any other suitable molding method. Alternatively, the base 12 may first be injection molded and the membrane 14 assembled and/or adhered to the base 12 in a subsequent manufacturing step. Generally, however, co-molding and over-molding methods are well known to those of ordinary skill in the art. If co-molding, over-molding, or like methods are used, it is generally desirable that the polymer used to form the membrane 14 be compatible with, and capable of adhering to, the polymer used to form the supporting base 12.

According to an example insert-molding process, the base 12 is pre-formed and the membrane 14 is formed thereto. In fact, it is generally desirable to overmold the polymer of the membrane 14 to the pre-formed base 12 before the polymer of the base 12 has completely cooled. This process avoids the need to manually mount, paste, or use an adhesive to adhere the base 12 to the membrane 14. In any case, the preformed base 12 is either manually or robotically assembled onto a specific predetermined location on a core of an injection molding machine. Mold halves of the injection molding machine close around the core. Molten plastic is injected into a mold cavity that is defined by the closed mold halves, the core, and the base 12, wherein a molten elastomeric material forms the membrane 14 in the shape of the mold cavity. After molding, the mold halves separate or open and the core retracts, leaving the base 12 intact with the membrane 14 to create the strainer 10, which may then be subjected to any desired finish operations, for example, deburring or deflashing.

Figure 5:
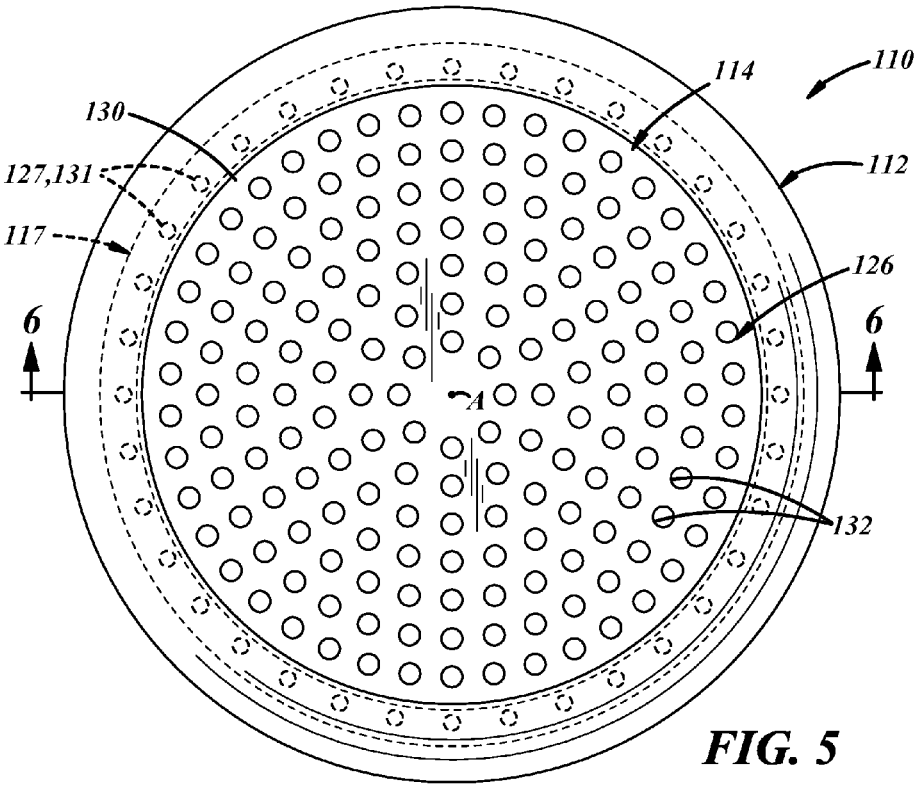
FIG. 5 is a top view according to another illustrative embodiment of an elastic membrane strainer.
Figure 6:
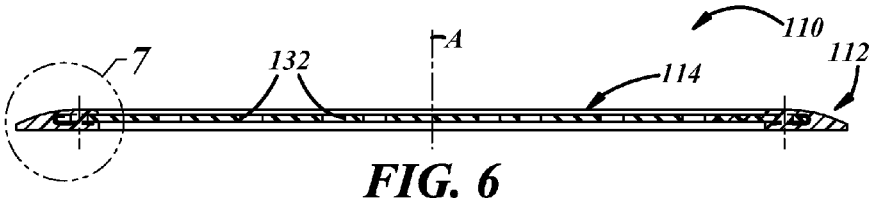
FIG. 6 is a cross-sectional view of the strainer of FIG. 5, taken along line 6-6 thereof.
Figure 7:
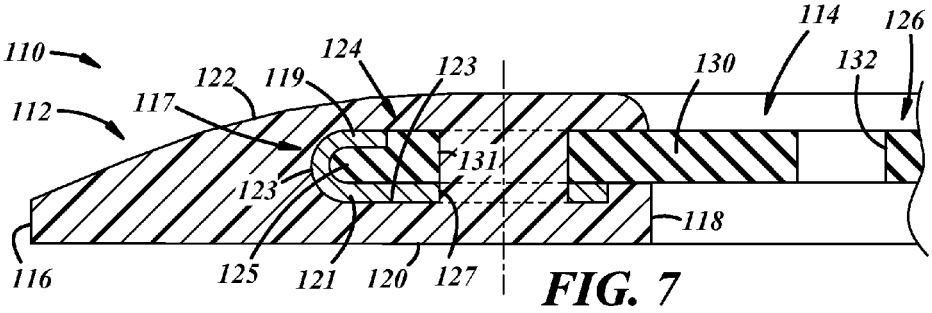
FIG. 7 is an enlarged, fragmentary, sectional view of the strainer of FIG. 5, taken from circle 7 of FIG. 6.

FIGS. 5-7 illustrate another illustrative embodiment of a strainer 110. This embodiment is similar in many respects to the embodiment of FIGS. 1-4 and like numerals between the embodiments generally designate like or corresponding elements throughout the several views of the drawing figures. Accordingly, the descriptions of the embodiments are hereby incorporated into one another, and description of subject matter common to the embodiments generally may not be repeated.

The strainer 110 generally may include a central longitudinal axis A, a base 112 extending transversely with respect to the axis A, and a membrane 114 coupled to the base 112 and also extending transversely with respect to the axis A to strain water as it flows therethrough down the drain D. Although not shown, the strainer 110 also may include a drain coupling, like that described above with respect to the embodiment of FIGS. 1-4.

The base 112 may include a radially outer base periphery 116, a radially inner base periphery 118, and lower and upper surfaces 20, 22 therebetween, and a membrane coupling pocket 123 radially outward of the radially inner base periphery 118 for receiving a corresponding portion of the membrane 114, as discussed in more detail below.

The membrane 114 includes a radially outer membrane periphery 124 coupled to the rigid base 112 and a perforate web 126 extending radially inwardly from the periphery 124. The membrane 114 includes a base coupling portion 125 carried in the membrane coupling pocket 123. The perforate web 126 also may include an imperforate radially outer margin 130, and a plurality of apertures 132 radially between the axis A (FIG. 6) and the imperforate radially outer margin 130.

A retainer 117 may be used to retain the membrane 114 to the base 112 and may include an annular component having upper and lower flanges 119, 121 for trapping the coupling portion 125 of the membrane 114 therebetween, and an outer rim 123 connecting the flanges 119, 121. The trapped portion 125 may be compressed or pinched between the flanges 119, 121 for good retention. Also, the retainer 117 may include one or more apertures 127 that may extend axially through one or both of the flanges 119, 121 and that may be provided in a circumferential array. Likewise, the membrane 114 may include one or more apertures 131 corresponding to the retainer apertures 127. In an embodiment where the base 112 is overmolded to the retainer 117 and the membrane 114, the apertures 127, 131 facilitate flow of base material therethrough to interlock the retainer 117 and the membrane 114 to the base 112.

At least the web 126 of the membrane 114 may be deflected and stretched to elongate, enlarge, or otherwise deform the apertures 132 to facilitate release of debris X that may be caught therein. Conversely, in a state of rest, the membrane 114 is flat.

Some aspects of the configuration of the strainers 10, 110 are significant in that they enable a solution to a problem not even addressed in the prior art of drain strainers. The presently disclosed strainers 10, 110 presents a planar or flat strainer surface in which debris can be easily wiped, sprayed, or otherwise moved away but is also deflectable/stretchable to facilitate release of debris. Thus, the strainers 10, 110 strains water well without becoming clogged with debris. Accordingly, the presently disclosed strainers 10, 110 provides a simple but effective solution to an everyday, common household problem. It is believed that the presently disclosed strainers 10, 110 presents a new type of drain strainer: an elastic membrane drain strainer.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Therefore, the claimed invention is not limited to the particular examples of illustrative embodiments disclosed herein but, instead, is defined by the accompanying claims.

The invention claimed is:

1. A drain strainer with a central longitudinal axis, and comprising:

a rigid base including a radially outer base periphery, a radially inner base periphery, and upper and lower surfaces therebetween, and extending in a base plane transverse to the axis; and a flexible, elastic membrane composed of an elastomeric material, and including a radially outer membrane periphery coupled to the rigid base and a perforate web extending radially inwardly from the radially outer membrane periphery in a membrane plane transverse to the axis and having a flat strainer surface to facilitate displacement of debris and being stretchable to facilitate release of debris, wherein the perforate web of the membrane includes an imperforate central portion.

2. The strainer of claim 1, wherein the radially outer membrane periphery is coupled to the rigid base at the radially inner base periphery and upper surface thereof.

3. The strainer of claim 1, wherein the base includes a membrane coupling pocket radially outward of the radially inner base periphery and in the upper surface, and the membrane includes a base coupling portion carried in the membrane coupling pocket.

4. The strainer of claim 3, wherein the base coupling portion is thicker than a radially inwardly adjacent portion of the membrane.

5. The strainer of claim 1, wherein the perforate web of the membrane also includes an imperforate radially outer margin.

6. The strainer of claim 5, wherein the perforate web of the membrane further includes a plurality of apertures radially between the imperforate central portion and the imperforate radially outer margin.

7. The strainer of claim 6, wherein the plurality of apertures is a circular array of apertures.

8. The strainer of claim 1, wherein the perforate web includes a plurality of circular holes.

9. The strainer of claim 1, wherein the base is composed of a thermoplastic material.

10. The strainer of claim 9, wherein the base is composed of polyethylene, and the membrane is composed of silicone.

11. The strainer of claim 1, wherein the base and membrane planes extend substantially perpendicular to the axis and parallel to one another.

12. The strainer of claim 1, wherein the base and membrane extend substantially co-planar.

13. The strainer of claim 1, further comprising a drain coupling extending downwardly from the base.

14. A drain strainer with a central longitudinal axis, and comprising:

a rigid base including a radially outer base periphery, a radially inner base periphery, and upper and lower surfaces therebetween, and extending in a base plane transverse to the axis; and a flexible, elastic membrane composed of an elastomeric material, and including a radially outer membrane periphery coupled to the rigid base and a perforate web extending radially inwardly from the radially outer membrane periphery in a membrane plane transverse to the axis and having a flat strainer surface to facilitate displacement of debris and having a central portion configured to be depressed for deflection and stretching of the flexible membrane to facilitate release of debris, wherein the membrane includes a radially outer margin having a plurality of apertures through which portions of the base extend to interlock the membrane to the base; and a retainer coupled to a radially outer margin of the membrane and carried in a membrane coupling pocket of the base that is radially outward of the radially inner base periphery.

15. The strainer of claim 14, wherein the retainer includes upper and lower flanges pinching the membrane and including a plurality of apertures, through which portions of the base extend to interlock the retainer to the base.

16. A sink, comprising:

a bottom having a drain opening therethrough;

a strainer housing disposed in the drain opening of the bottom and having a mounting flange carried by the bottom around the drain opening; and the strainer of claim 1, wherein the base locates at a seam between the sink bottom and the flange, at the lower surface and radially outer base periphery of the base.

17. The sink of claim 16, wherein the strainer is interference fit to the sink bottom.

18. A drain strainer with a central longitudinal axis, and comprising:

a rigid base including a radially outer base periphery, a radially inner base periphery, and upper and lower surfaces therebetween, and extending in a base plane transverse to the axis; and a flexible membrane including a radially outer membrane periphery interlocked to the rigid base and a perforate web extending radially inwardly from the radially outer membrane periphery in a membrane plane transverse to the axis and having a flat strainer surface in a planar state of rest to facilitate displacement of debris and having a central portion configured to be depressed for deflection and stretching of the flexible membrane to a conical shape in a stretched state to facilitate release of debris; and a retainer coupled to a radially outer margin of the membrane, and wherein the retainer includes upper and lower flanges pinching the membrane and including a plurality of apertures, through which portions of the base extend to interlock the retainer and the base.

19. The strainer of claim 18, wherein the base is composed of a thermoplastic material, and the membrane is composed of an elastomeric material.

20. The strainer of claim 18, wherein the base is an overmolded base, and wherein the membrane includes a plurality of apertures, through which portions of the base extend to interlock the membrane and the base.

* * * * *